US008471668B2

(12) United States Patent
Hsieh et al.

(10) Patent No.: US 8,471,668 B2
(45) Date of Patent: Jun. 25, 2013

(54) COIL DEVICE

(75) Inventors: Roger Hsieh, Hsinchu (TW); Cheng-Chang Lee, Hsinchu (TW); Chun-Tiao Liu, Hsinchu (TW)

(73) Assignee: Cyntec Co., Ltd., Hsinchu (TW)

( * ) Notice: Subject to any disclaimer, the term of this patent is extended or adjusted under 35 U.S.C. 154(b) by 56 days.

(21) Appl. No.: 13/179,884

(22) Filed: Jul. 11, 2011

(65) Prior Publication Data

US 2012/0019343 A1 Jan. 26, 2012

Related U.S. Application Data

(60) Provisional application No. 61/367,007, filed on Jul. 23, 2010.

(51) Int. Cl.
*H01F 5/00* (2006.01)

(52) U.S. Cl.
USPC ..... 336/200

(58) Field of Classification Search
USPC ..... 336/65, 83, 192, 200, 206–208, 232
See application file for complete search history.

(56) References Cited

U.S. PATENT DOCUMENTS

| | | | | |
|---|---|---|---|---|
| 6,710,694 | B2 | 3/2004 | Matsuta et al. | |
| 7,046,114 | B2 | 5/2006 | Sakata | |
| 7,696,849 | B2 * | 4/2010 | Ito et al. | 336/192 |
| 8,050,045 | B2 * | 11/2011 | Okuzawa et al. | 361/763 |
| 8,174,349 | B2 * | 5/2012 | Yoshida et al. | 336/200 |
| 2005/0050717 | A1 | 3/2005 | Yoshida et al. | |
| 2010/0052838 | A1 | 3/2010 | Matsuta et al. | |

FOREIGN PATENT DOCUMENTS

| | | |
|---|---|---|
| CN | 100375207 C | 3/2008 |
| JP | 2010062187 | 3/2010 |

* cited by examiner

*Primary Examiner* — Tuyen Nguyen
(74) *Attorney, Agent, or Firm* — Kirton McConkie; Evan R. Witt

(57) ABSTRACT

A coil device includes a first coil pattern, a second coil pattern, an insulating layer, a magnetic covering element and a number of conductive pillars. The second coil pattern is disposed above the first coil pattern, and is spaced apart from the first coil pattern. The insulating layer covers the first coil pattern and the second coil pattern and defines an opening surrounded by the first coil pattern and the second coil pattern. The magnetic covering element covers the insulating layer and extends into the opening. The conductive pillars are disposed within the magnetic covering element and are exposed from a bottom side of the magnetic covering element. A portion of the conductive pillars are electrically connected to the first coil pattern, and another portion of the conductive pillars are connected to the second coil pattern. The coil device can be easily manufactured.

21 Claims, 4 Drawing Sheets

COIL DEVICE

CROSS REFERENCE TO RELATED PATENT APPLICATION

This patent application claims priority to U.S. provisional patent application No. 61/367,007 filed Jul. 23, 2011.

FIELD OF THE INVENTION

The present invention relates generally to coils, and more particularly relates to a coil device which can function as a common mode choke coil.

BACKGROUND OF THE INVENTION

FIG. 1 is a schematic view of a conventional common mode choke coil, and FIG. 2 is an exploded schematic view of the common mode choke coil of FIG. 1. Referring to FIGS. 1 and 2, a conventional common mode choke coil 1 includes magnetic substrates 3 and 10, a composite layer 7, an adhesive layer 8 interposed between the magnetic substrates 3 and 10, and side electrodes 11*a*, 11*b*, 11*c*, 11*d* for electrically connecting to other components. The composite layer 7 includes insulating layers 6*a*, 6*b* and 6*c* sequentially stacked on the magnetic substrate 3, a coil pattern 4 disposed within the insulating layer 6*b*, and a coil pattern 5 disposed within the insulating layer 6*c*. One end of the coil pattern 4 is electrically connected to a conductive wire 12*a* via a via hole 13*a*, and the other end of the coil pattern 4 is electrically connected to a conductive wire 12*c*. One end of the coil pattern 5 is electrically connected to a conductive wire 12*b* through via holes 13*b*, 13*c*, and the other end of the coil pattern 5 is electrically connected to a conductive wire 12*d*. In addition, the conductive wire 12*a* is electrically connected to the side electrode 11*a*, the conductive wire 12*b* is electrically connected to the side electrode 11*b*, the conductive wire 12*c* is electrically connected to the side electrode 11*c*, and the conductive wire 12*d* is electrically connected to the side electrode 11*d*.

Since the process for manufacturing the side electrodes is complicated and each common mode choke coil 1 needs to be fixed to a fixture during the mass production, the production efficiency of the common mode choke coil 1 is low. In addition, it is more and more difficult to form the side electrodes as the size of the common mode choke coil 1 is becoming smaller and smaller.

SUMMARY OF THE INVENTION

The present invention provides a coil device, which can be easily manufactured.

To achieve above advantage, the present invention provides a coil device, which includes a first coil pattern, a second coil pattern, an insulating layer, a magnetic covering element and a number of conductive pillars. The second coil pattern is disposed above the first coil pattern, and is spaced apart from the first coil pattern. The insulating layer covers the first coil pattern and the second coil pattern and defines an opening surrounded by the first coil pattern and the second coil pattern. The magnetic covering element covers the insulating layer and extends into the opening. The conductive pillars are disposed within the magnetic covering element and are exposed from a bottom side of the magnetic covering element. A portion of the conductive pillars are electrically connected to the first coil pattern, and another portion of the conductive pillars are electrically connected to the second coil pattern.

In one embodiment of the present invention, the magnetic covering element includes a magnetic substrate and a magnetic cover. The magnetic substrate includes a carrying side and a bottom side opposite to the carrying side, wherein the bottom side of the magnetic substrate is the bottom side of the magnetic covering element. The insulating layer is disposed at the carrying side, and the conductive pillars are disposed within the magnetic substrate. The magnetic cover covers the carrying side and the insulating layer.

In one embodiment of the present invention, the coil device further includes a plurality of conductive wires, wherein the first coil pattern and the second coil pattern are electrically connected to the corresponding conductive pillars via the conductive wires.

In one embodiment of the present invention, the conductive wires are embedded into the magnetic substrate, and each of the conductive wires includes a surface that is located in a same reference plane with the carrying side.

In one embodiment of the present invention, the conductive wires are embedded into the magnetic cover.

In one embodiment of the present invention, the coil device further includes a plurality of electrodes disposed at the bottom side of the magnetic substrate and electrically connected to the conductive pillars, respectively.

In one embodiment of the present invention, the electrodes are embedded into the magnetic substrate and each of the electrodes comprises a surface that is located in a same reference plane with the bottom side of the magnetic substrate.

In one embodiment of the present invention, the coil device further includes a plurality of conductive wires disposed within the magnetic covering element. The first coil pattern and the second coil pattern are electrically connected to corresponding conductive pillars via the conductive wires.

In one embodiment of the present invention, the coil device further includes a plurality of electrodes disposed at the bottom side of the magnetic covering element and electrically connected to the conductive pillars, respectively.

In one embodiment of the present invention, the electrodes are embedded into the magnetic covering element, and each of the electrodes comprises a surface that is located in a same reference plane with the bottom side of the magnetic covering element.

In one embodiment of the present invention, the magnetic covering element is formed in one piece.

In one embodiment of the present invention, a weight ratio of magnetic powder of the magnetic covering element is in a range from 75% to 95%, and the effective permeability of the magnetic covering element is greater than 4.

To achieve above advantage, another coil device is also provided. The coil device includes an insulating layer; a plurality of coil patterns, a magnetic covering element and a plurality of conductive pillars. The coil patterns are stacked in the insulating layer and are spaced apart from each other by the insulating layer. The magnetic covering element covers the insulating layer. The conductive pillars are disposed within the magnetic covering element and electrically connected to corresponding coil patterns, wherein the conductive pillars are exposed from a bottom side of the magnetic covering element.

To achieve above advantage, another coil device is also provided. The coil device includes an insulating layer, a plurality of coil patterns, a magnetic covering element and a plurality of conductive pillars. The insulating layer is formed in a ring shape. The coil patterns are stacked within the insulating layer and are spaced apart from each other by the insulating layer. The magnetic covering element consists of a magnetic substrate and a magnetic cover, wherein the magnetic substrate includes a carrying side and a bottom side opposite to the carrying side, the insulating layer is disposed at the carrying side and in contact with the carrying side, and the magnetic cover covers the carrying side and the insulating layer. The insulating layer is entirely covered by the magnetic covering element. The conductive pillars are disposed within the magnetic substrate and electrically connected to the corresponding coil patterns. The conductive pillars are exposed from a bottom side of the magnetic substrate.

In each of the above coil devices, because the conductive pillars electrically connected to the coil patterns extends to the bottom side of the magnetic covering element, the electrodes for electrically connecting to other elements can be disposed at the bottom side of the magnetic covering element. The manufacturing process of forming the electrodes at the bottom side of the magnetic covering element has better efficiency, thereby improving the manufacturing efficiency of the coil device of the present invention.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
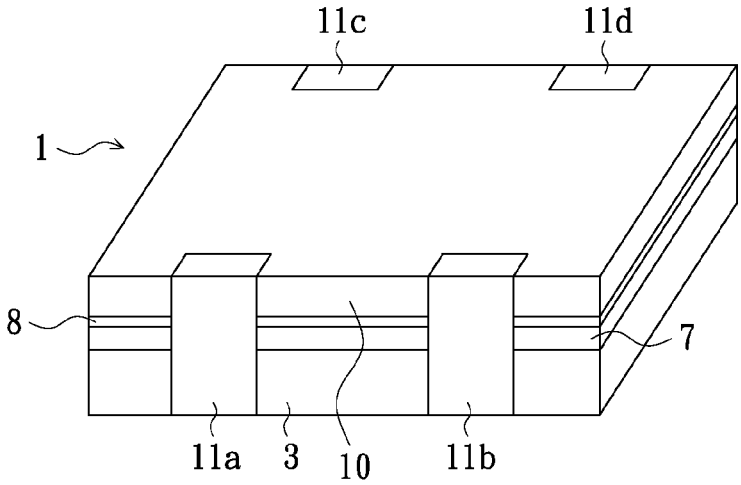
FIG. 1 (Prior Art)
FIG. 1 is a schematic view of a conventional common mode choke coil.
Figure 2:
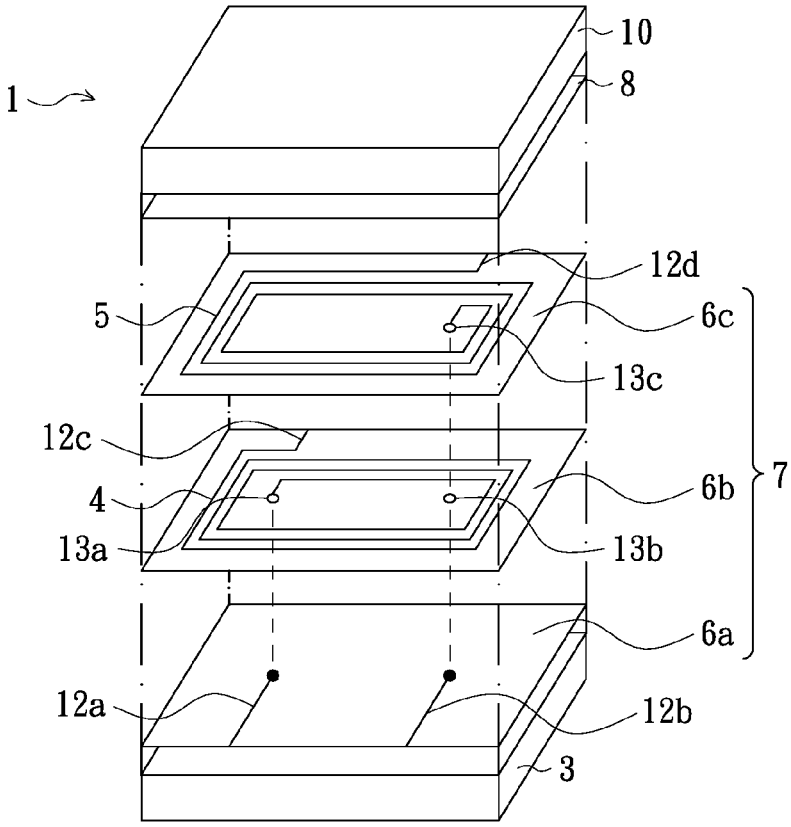
FIG. 2 (Prior Art)
FIG. 2 is an exploded schematic view of the common mode choke coil shown in FIG. 1
Figure 3:
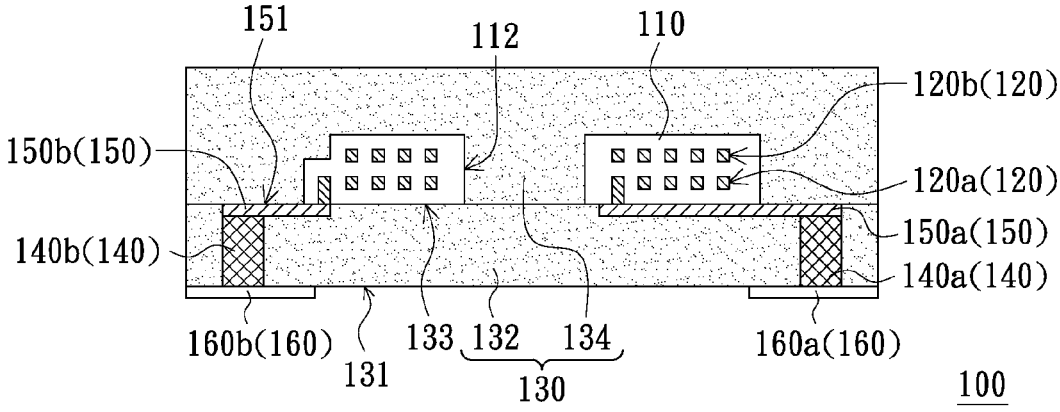
FIG. 3 is a schematic cross sectional view of a coil device in accordance with an embodiment of the present invention.
Figure 4:
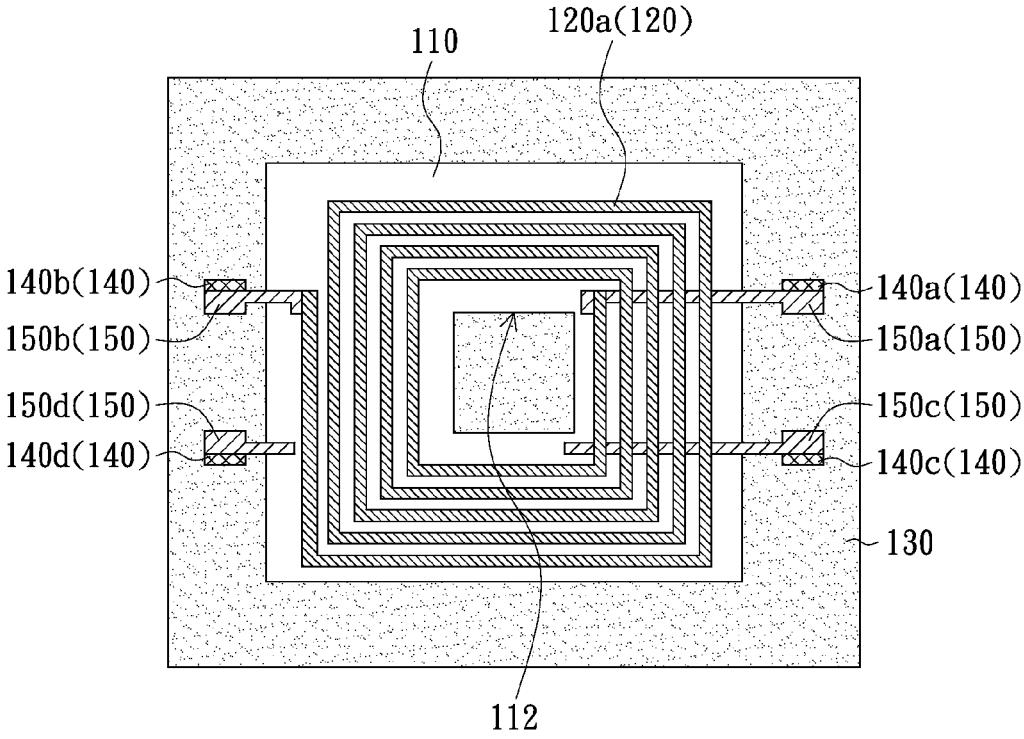
FIG. 4 is a top schematic view of partial elements shown in FIG. 3.

FIG. 3 is a schematic cross sectional view of a coil in accordance with an embodiment of the present invention, and FIG. 4 is a top schematic view of partial elements shown in FIG. 3. The second coil pattern is omitted in FIG. 4. Referring to FIGS. 3 and 4, a coil device 100 of the present embodiment can be, but not limited to, a common mode choke coil. The coil device 100 includes an insulating layer 110, a number of coil patterns 120, a magnetic covering element 130 and a number of conductive pillars 140.

The coil patterns 120 are stacked within the insulating layer 110 and are covered by the insulating layer 110. The coil pattern 120 of the present embodiment, for example, includes a first coil pattern 120*a* and a second coil pattern 120*b*; but in other embodiments, the number of the coil patterns 120 can be more than two. The second coil pattern 120*b* is disposed above the first coil pattern 120*a*, and is spaced apart from the first coil pattern 120*a*. The first coil pattern 120*a* and the second coil pattern 120*b* are isolated from each other by the insulating layer 110. The insulating layer 110, for example, is formed in a ring shape and has an opening 112. The first coil pattern 120*a* and the second coil pattern 120*b* surrounds the opening 112. The above-mentioned ring shape can be, but not limited to, a circular ring shape, an elliptic ring shape, a square ring shape or a polygon ring shape.

The magnetic covering element 130 covers the insulating layer 110 and extends into the opening 112 to cover the surface of the insulating layer 110. The conductive pillars 140 are disposed within the magnetic covering element 130 and are exposed from a bottom side 131 of the magnetic covering element 130. The magnetic covering element 130, for example, includes a magnetic substrate 132 and a magnetic cover 134. The magnetic substrate 132 has a carrying side 133 and a bottom side opposite to the carry side 133, wherein the bottom side of the magnetic substrate 132 is the bottom side 131 of the magnetic covering element 130. The insulating layer 110 is disposed at the carrying side 133, and the magnetic cover 134 covers the carrying side 133 and the insulating layer 110. The conductive pillars 140 are disposed within the magnetic substrate 132. The conductive pillars 140, for example, are conductive via plugs. The conductive pillars 140 are electrically connected to the corresponding coil patterns 120. In detail, a portion of the conductive pillars 140 (e.g., the conductive pillars 140*a*, 140*b*) are electrically connected to the first coil pattern 120*a*, and another portion of the conductive pillars (e.g., the conductive pillars 140*c*, 140*d*) are electrically connected to the second coil pattern 120*b*. In addition, the insulating layer 110, for example, but not limited to, is a layer of a polymer such as polyimide or epoxy whose permeability (μ) is equal to 1.

In the present embodiment, the coil pattern 120, for example, are electrically connected to corresponding conductive pillars 140 via a number of conductive wires 150. In detail, one end of the first coil pattern 120*a* is electrically connected to the corresponding conductive pillar 140*a* via the conductive wire 150*a* and the other end of the first coil pattern 120*a* is electrically connected to the corresponding conductive pillar 140*b* via the conductive wire 140*b*. One end of the second coil pattern 120*b* is electrically connected to the corresponding conductive pillar 140*c* via the conductive wire 150*c* and the other end of the second coil pattern 120*b* is electrically connected to the corresponding conductive pillar 140*d* via the conductive wire 140*d*.

It should be noted that each of the coil patterns 120 of the present embodiment is, for example, a spiral pattern consisting of a plurality of line segments located in a same layer. In another embodiment, each of the coil patterns can be a spiral pattern consisting of a plurality of line segments located in different layers. For example, each of the coil patterns can include a lower layer pattern and an upper layer pattern stacked on the lower layer pattern. One end of the upper layer pattern is electrically connected to one end of the lower layer pattern. The other end of the upper layer pattern is electrically connected to the corresponding conductive pillar via the corresponding wire, and the other end of the lower layer pattern is electrically connected to the corresponding conductive pillar via the corresponding wire.

In addition, the conductive wires 150 of the present embodiment, for example, are embedded into the magnetic substrate 132, and a surface 151 of each of the conductive wires 150 and the carrying side 13 of the magnetic substrate 132 are located in a same reference plane. Furthermore, the coil device 100 of the present embodiment, for example, further includes a number of electrodes 160 which are disposed at the bottom side 131 of the magnetic covering element 130 and electrically connected to corresponding conductive pillars 140, individually. For example, the electrode 160*a* is electrically connected to the conductive pillar 140*a*, the electrode 160*b* is electrically connected to the conductive pillar 140*a*. The electrically conductive pillar 140*c* and the electrically conductive pillar 140*d* are also electrically connected to corresponding electrodes (not shown). Thus, signals of the coil device 100 can be transmitted to the coil patterns 120 via the electrodes 160, the conductive pillars 140 and the conductive wires 150.

There are many methods for manufacturing the coil device 100. For example, the coil patterns 120 can be formed by wrapping enameled wires, or the coil patterns 120 and the insulating layer 110 can be formed simultaneously by a thin film process of a flexible substrate. In addition, the magnetic substrate 132 and the magnetic cover 134, which entirely cover the coil patterns 120, can be formed by molding and curing a mixture of magnetic powder and polymer using an injection molding process or a transfer molding process. The magnetic covering element 130 can also be formed in one piece. In another embodiment, a low temperature co-fired ceramics (LTCC) process can be used to form a stacked structure of the magnetic substrate 132, the coil patterns 120 and the insulating layer 110. In addition, the coil patterns 120 can be formed on a previously formed magnetic substrate 132 by a thin film process or a micro manufacturing process.

A manufacturing process of the coil device 100 is described accompanying with figures as an example, but the manufacturing process of the coil device 100 is not limited to this example.

Figure 5A:
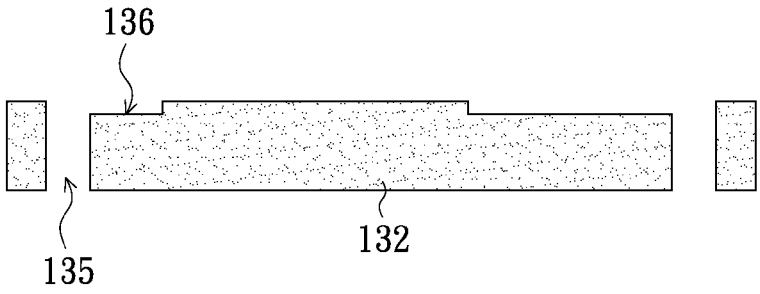
FIGS. 5A to 5C illustrate a manufacturing process for a coil device in accordance with an embodiment of the present invention.
Figure 5B:
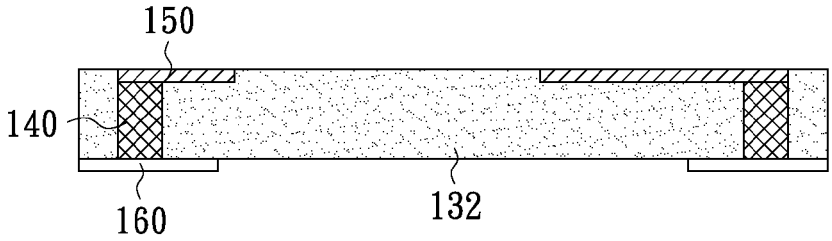
Figure 5C:
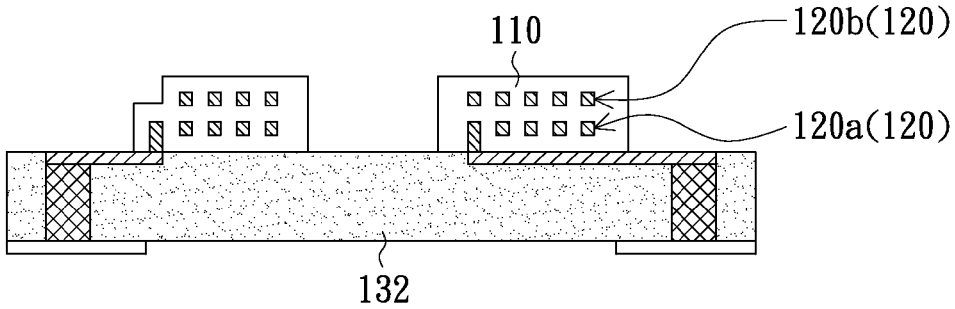

FIGS. 5A to 5C illustrates a manufacturing process of the coil device 100 in accordance with an embodiment of the present invention. Referring to FIG. 5A, the manufacturing process of the coil device of the present embodiment includes the following steps. Firstly, the magnetic substrate 132 having a through hole 135 and a receiving groove 136 is formed. The magnetic substrate 132 can be formed by using an LTCC process to sinter stacked layers. In addition, the magnetic substrate 132 can also be formed by the transfer molding process or the injection molding process. The material of the magnetic substrate 132, for example, is a mixture of magnetic powder and a non-magnetic material, wherein the non-magnetic material functions as a binder of the magnetic powder. In another embodiment, the magnetic substrate 132 can be formed by molding and curing a mixture of magnetic powder and polymer. Compared with the known ferrite substrate, the substrate 132 has better toughness, and this is helpful for the following processes of the coil patterns. In addition, considering the device characteristic and the process formability, a weight ratio of the magnetic powder of the magnetic substrate 132, for example, is in a range from 75% to 95%, and the effective permeability of the magnetic substrate 132, for example, is greater than 4.

In succession, as shown FIG. 5B, the conductive pillars 140 and the conductive wires 150 can be formed by an electroforming process, and then the conductive pillars 140 and the conductive wires 150 are polished, for example, by a chemical mechanical polishing (CMP) process to remove the portions of the conductive pillars 140 and the conductive wires 150 that protrudes from the surface of the magnetic substrate 132. After that, the electrodes 160 are formed by a thin film process or a printing process.

After that, as shown in FIG. 5C, a thin film process is performed to form the coil patterns 120 (e.g., the first coil pattern 120*a* and the second coil pattern 120*b*) and the insulating layer 110 on the magnetic substrate 132.

Then, an injection molding process or a transferring molding process is performed to cover the coil patterns 120 and the insulating layer 110 with a mixture material of magnetic powder and a non-magnetic material, thereby forming the magnetic cover 134 (as shown in FIG. 3) connected to the magnetic substrate 132 and a close magnetic circuit. The proportion of the materials of the magnetic cover 134 can be adjusted according to the required characteristic of the coil device and the used manufacturing process. The proportion of the magnetic powder and the non-magnetic material can be same or different with that of the magnetic substrate 132, and the effective permeability of the magnetic covering element 130, for example, is greater than 4.

In the coil device 100 of the present embodiment, the electrodes 160 are formed at the bottom side 131 of the magnetic covering element 130, and the electrodes 160 can be formed before the following processes such as forming the coil patterns 120. Thus, even if the size of the coil device 100 is becoming smaller and smaller, a degree of difficulty for forming the electrodes is not obviously increased. Compared with the known manufacturing process for the side electrodes, the present embodiment disposes the electrodes 160 at the bottom side 131 of the magnetic covering element, and thus a manufacturing process having improved efficiency can be used to form the electrodes 160. As a result, the production efficiency of the coil device 100 of the present embodiment is improved.

Figure 6:
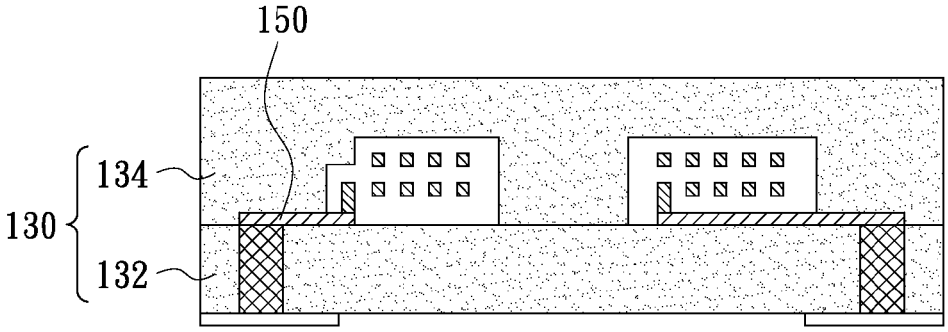
FIG. 6 is a schematic cross sectional view of a coil device in accordance with another embodiment of the present invention.

It is to be noted that although the magnetic covering element 130 of the above embodiment includes the magnetic substrate 132 and the magnetic cover 134, the magnetic covering element can be formed in one piece in another embodiment. In addition, although the conductive wires 150 of above embodiment are embedded in the magnetic substrate 132, in another embodiment as shown in FIG. 6, the conductive wires 150 are not embedded in the magnetic cover 134. Additionally, as shown in FIG. 7, in another embodiment, the electrodes 160 can be embedded into the magnetic substrate 132 of the magnetic covering element 130, and a surface 161 of each electrode 160 and the bottom side 131 of the magnetic substrate 132 are located in a same reference plane.

Figure 7:
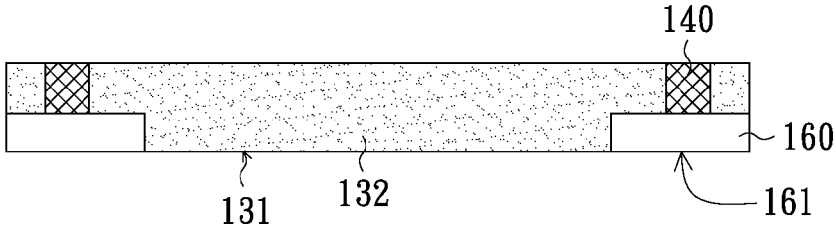
FIG. 7 is a schematic cross sectional view of a magnetic substrate, conductive pillars and electrodes in accordance with another embodiment of the present invention.
Figure 8:
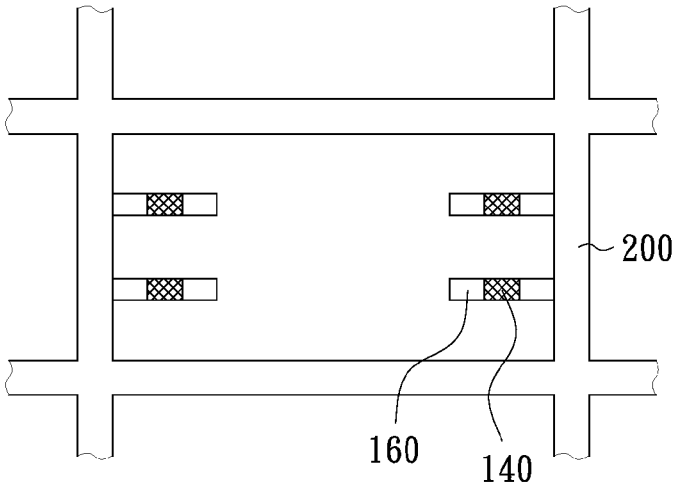
FIG. 8 is a top schematic view of a lead frame in accordance with an embodiment of the present invention.

In one embodiment, a lead frame accompanying with an injection molding process or a transferring molding process can be used to form the structure shown in FIG. 7. FIG. 8 illustrates a top schematic view of a lead frame in accordance with an embodiment of the present invention. Referring to FIGS. 7 and 8, a lead frame 200 is divided into a number of sections (only one section is shown in FIG. 8), and each of the sections is used to manufacture one coil device and has a number of electrodes 160. The corresponding conductive pillars 140 can be formed on each of the electrodes 160. After that, the magnetic substrate 132 can be formed by the injection molding process or the transferring process. Then, a cutting process is performed to obtain the structure shown in FIG. 7.

In the coil device of the present invention, because the conductive pillars electrically connected to the coil patterns extends to the bottom side of the magnetic covering element, the electrodes for electrically connecting to other elements can be disposed at the bottom side of the magnetic covering element. Compared with the convention manufacturing process of the side electrodes, the manufacturing process of the electrodes of the coil device of the present invention has better efficiency, and thus the manufacturing efficiency of the coil device of the present invention is improved.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A coil device comprising:

a first coil pattern;

a second coil pattern disposed above the first coil pattern and spaced apart from the first coil pattern;

an insulating layer covering the first coil pattern and the second coil pattern, the insulating layer defining an opening surrounded by the first coil pattern and the second coil pattern;

a magnetic covering element covering the insulating layer and extending into the opening; and a plurality of conductive pillars disposed within the magnetic covering element, wherein sidewalls of the conductive pillars are entirely covered by the magnetic covering element and at least an end of each of the conductive pillars is exposed from a bottom side of the magnetic covering element, a portion of the conductive pillars are electrically connected to the first coil pattern and another portion of the conductive pillars are electrically connected to the second coil pattern.

2. The coil device as claimed in claim 1, wherein the magnetic covering element comprises:

a magnetic substrate comprising a carrying side and a bottom side opposite to the carrying side, wherein the bottom side of the magnetic substrate is the bottom side of the magnetic covering element, the insulating layer is disposed at the carrying side, and the conductive pillars are disposed within the magnetic substrate; and a magnetic cover covering the carrying side and the insulating layer.

3. The coil device as claimed in claim 2 further comprising a plurality of conductive wires, wherein the first coil pattern and the second coil pattern are electrically connected to the corresponding conductive pillars via the conductive wires.

4. The coil device as claimed in claim 3, wherein the conductive wires is embedded into the magnetic substrate, and each of the conductive wires comprises a surface that is located in a same reference plane with the carrying side of the magnetic substrate.

5. The coil device as claimed in claim 3, wherein the conductive wires are embedded into the magnetic cover.

6. The coil device as claimed in claim 2 further comprising a plurality of electrodes disposed at the bottom side of the magnetic substrate and electrically connected to the conductive pillars.

7. The coil device as claimed in claim 6, wherein the electrodes are embedded into the magnetic substrate and each of the electrodes comprises a surface that is located in a same reference plane with the bottom side of the magnetic substrate.

8. The coil device as claimed in claim 1 further comprising:

a plurality of conductive wires disposed within the magnetic covering element, wherein the first coil pattern and the second coil pattern are electrically connected to corresponding conductive pillars via the conductive wires; and a plurality of electrodes disposed at the bottom side of the magnetic covering element and electrically connected to the conductive pillars.

9. The coil device as claimed in claim 8, wherein the electrodes are embedded into the magnetic covering element, and each of the electrodes comprises a surface that is located in a same reference plane with the bottom side of the magnetic covering element.

10. The coil device as claimed in claim 1, wherein the magnetic covering element is formed in one piece.

11. The coil device as claimed in claim 1, wherein a weight ratio of magnetic powder of the magnetic covering element is in a range from 75% to 95%, and effective permeability of the magnetic covering element is greater than 4.

12. A coil device comprising:

an insulating layer;

a plurality of coil patterns stacked in the insulating layer, and the coil patterns being spaced apart from each other by the insulating layer;

a magnetic covering element covering the insulating layer; and a plurality of conductive pillars disposed within the magnetic covering element and electrically connected to the corresponding coil patterns, wherein sidewalls of the conductive pillars are entirely covered by the magnetic covering element and at least an end of each of the conductive pillars is exposed from a bottom side of the magnetic covering element.

13. The coil device as claimed in claim 12, wherein the magnetic covering element comprising:

a magnetic substrate comprising a carrying side and a bottom side opposite to the carrying side, wherein the bottom side of the magnetic substrate is the bottom side of the magnetic covering element, the insulating layer is disposed at the carrying side, and the conductive pillars are disposed within the magnetic substrate; and a magnetic cover covering the carrying side and the insulating layer.

14. The coil device as claimed in claim 13 further comprising a plurality of conductive wires, wherein the coil patterns are electrically connected to the corresponding conductive pillars via the conductive wires.

15. The coil device as claimed in claim 14, wherein the conductive wires are embedded into the magnetic substrate, and each of the conductive wires comprises a surface that is located in a same reference plane with the carrying side.

16. The coil device as claimed in claim 14, wherein the conductive wires are embedded into the magnetic cover.

17. The coil device as claimed in claim 12 further comprising:

a plurality of conductive wires disposed within the magnetic covering element, wherein the coil patterns are electrically connected to the corresponding conductive pillars via the conductive wires; and a plurality of electrodes disposed at the bottom side of the magnetic covering element and electrically connected to the conductive pillars, respectively.

18. The coil device as claimed in claim 12, wherein the magnetic covering element is formed in one piece.

19. The coil device as claimed in claim 12, wherein a weight ratio of magnetic powder in the magnetic covering element is in a range from 75% to 95%, and effective permeability of the magnetic covering element is greater than 4.

20. A coil device comprising:

an insulating layer formed in a ring shape;

a plurality of coil patterns stacked in the insulating layer, and the coil patterns being spaced apart from each other by the insulating layer;

a magnetic covering element consisting of a magnetic substrate and a magnetic cover, the magnetic substrate comprising a carrying side and a bottom side opposite to the carrying side, the insulating layer being disposed at the carrying side and in contact with the carrying side, the magnetic cover entirely covering the carrying side and the insulating layer, and the insulating layer being entirely covered by the magnetic covering element;

a plurality of conductive pillars disposed within the magnetic substrate and electrically connected to the corresponding coil patterns, and sidewalls of the conductive pillars being entirely covered by the magnetic covering element and at least an end of each of the conductive pillars being exposed from a bottom side of the magnetic substrate;

a plurality of conductive wires disposed within the magnetic covering element, and the coil patterns being electrically connected to the corresponding conductive pillars via the conductive wires; and a plurality of electrodes disposed at the bottom side of the magnetic substrate and the electrodes being electrically connected to the conductive pillars, respectively.

21. The coil device as claimed in claim 20, wherein the conductive pillar is formed on a lead frame having the electrodes.

* * * * *